US005988948A

United States Patent [19]

Featherstone

[11] Patent Number: 5,988,948

[45] Date of Patent: Nov. 23, 1999

[54] UNDERWATER PLOUGH AND METHOD FOR VARYING PLOUGHING DEPTH

[75] Inventor: Jeremy J. R. Featherstone, Essex, United Kingdom

[73] Assignee: Cable and Wireless PLC, London, United Kingdom

[21] Appl. No.: 08/989,398

[22] Filed: Dec. 12, 1997

[30] Foreign Application Priority Data

Sep. 4, 1997 [EP] European Pat. Off. ..... 97306880

[51] Int. Cl.[6] ..... F16L 1/12; E02F 3/76

[52] U.S. Cl. ..... 405/164; 405/158; 405/174; 405/181; 405/164; 37/409; 37/410

[58] Field of Search ..... 405/158, 159, 405/160, 161, 162, 163, 164, 181, 174; 37/309, 308, 409, 410, 413, 414, 406, 444, 903; 172/8, 699, 716, 735, 736

[56] References Cited

U.S. PATENT DOCUMENTS

| | | | |
|---|---|---|---|
| 1,886,510 | 11/1932 | Murphy | 405/181 |
| 2,099,527 | 11/1937 | Lawton | 405/165 |
| 2,142,136 | 1/1939 | Lawton | 37/308 |
| 2,530,414 | 11/1950 | Wells | 37/409 |
| 3,038,265 | 6/1962 | Hunger et al. | 37/409 |
| 3,074,190 | 1/1963 | Wahl | 37/410 X |
| 3,344,615 | 10/1967 | Coffey | 405/181 |
| 3,400,542 | 9/1968 | Davis | 405/175 |
| 3,462,963 | 8/1969 | Moore | 405/164 |
| 3,641,780 | 2/1972 | Ede | 405/159 |
| 3,898,852 | 8/1975 | Ezoe et al. . | |
| 4,011,727 | 3/1977 | Suzuki et al. . | |
| 4,129,992 | 12/1978 | Carlsson et al. . | |
| 4,293,238 | 10/1981 | Kuzin et al. | 405/181 X |
| 4,655,639 | 4/1987 | Reece | 405/181 |
| 4,664,553 | 5/1987 | Grinsted et al. . | |
| 4,759,138 | 7/1988 | Grinstead | 405/164 X |
| 4,787,777 | 11/1988 | Harmstorf | 405/159 X |
| 4,802,793 | 2/1989 | Grinstead et al. | 405/159 X |
| 4,892,443 | 1/1990 | Kunze et al. | 405/181 X |
| 4,896,998 | 1/1990 | Reece | 405/160 |
| 4,927,294 | 5/1990 | Magnani et al. | 405/174 X |
| 4,986,697 | 1/1991 | Lynch | 405/158 X |
| 5,462,389 | 10/1995 | Messina . | |

FOREIGN PATENT DOCUMENTS

| | | | |
|---|---|---|---|
| 1493346 | 11/1977 | European Pat. Off. . | |
| 278705A1 | 8/1988 | European Pat. Off. . | |
| 296783 | 12/1988 | European Pat. Off. . | |
| 2069094 | 8/1981 | United Kingdom | 405/161 |
| 2285821A | 7/1995 | United Kingdom . | |

OTHER PUBLICATIONS

J. Featherstone, "Protection of Surfave Laid and Build Submarine Telecom; Cable Against External Aggression", Disclosed Apr. 30, 1997.

"Cable Protection—Solution Through New Installation and Burial Apparatus" published in SupOptic '97 Conference Proceedings, May 12th–15th, 1997, San Francisco.

Cable and Wireless, "Vari–Plough—Principle 1", Apr. 8, 1997.

Cable and Wireless, "Vari–Plough—Principle 2", Apr. 8, 1997.

*Primary Examiner*—David Bagnell
*Assistant Examiner*—Jong-Suk Lee
*Attorney, Agent, or Firm*—Pillsbury Madison & Sutro LLP

[57] ABSTRACT

An underwater plough for ploughing an underwater bed, the plough comprising a first share (10) and a second share (21) which is movable with respect to the first share whereby the depth of the ploughing profile presented by the plough can be varied.

23 Claims, 8 Drawing Sheets

UNDERWATER PLOUGH AND METHOD FOR VARYING PLOUGHING DEPTH

FIELD OF THE INVENTION

The present invention relates to an underwater plough and methods of ploughing an underwater bed, for instance in order to bury an elongate member (such as a cable or pipe) in the underwater bed.

DESCRIPTION OF THE PRIOR ART

About 60% of submarine telecom cable failures are due to 'external aggression' from fishing gear and anchors. Cable owners are interested in reducing this failure rate in a cost effective manner, principally through cable burial by submarine plough. Typically, burial specifications are on a depth of burial basis. Since survey data tends to be poor, it is hard for the installer to be certain he can achieve the required depth of burial.

In addition, a simple burial depth is not a very sophisticated way of specifying the requirement. A cable buried 2 m deep in very soft soil is not protected as well as a cable buried only 0.5 m deep in hard ground. Ultimately it is protection that the cable owner seeks.

In recognition of this, some cable burial specifications do now ask for different depths of burial for different parts of the route, based on survey data (or if available, historical failure data for other cables in the region). This puts increased emphasis on accurate survey data giving soil properties which can be related to buryability. It has also led to a much greater range of depths being specified, so that in soft soils 3 m may be specified as opposed to only 1 m.

One approach is to use different size ploughs for different parts of a route, so that a 1 m plough may be used for the hard ground and a 3 m soft ground plough for those areas expected to have weak soils. However, this approach has a number of problems. Firstly, recovering the plough to the ship and replacing it with a larger plough inevitably results in higher costs. Secondly, the recovery process inevitably leaves unburied sections of cable which require post lay burial. Thirdly, conventional 3 m ploughs have poor hard ground capability, may not handle repeaters and cannot be adjusted to zero burial depth. Fourthly, a conventional 3 m plough is much bigger than a 1 m plough, which results in handling problems from existing A frames and deck spreads.

SUMMARY OF THE INVENTION

In accordance with a first aspect of a present invention there is provided an underwater plough for ploughing an underwater bed, the plough comprising a first share and a second share which is movable with respect to the first share whereby the depth of the ploughing profile presented by the plough can be varied.

The second share may present a ploughing profile or surface in all positions, or may have a retracted non-ploughing position in which only the first share ploughs the underwater bed.

The first aspect of the present invention provides a particularly elegant solution to the problems presented above. The adjustable second share can be raised and lowered as required in order to vary the depth of the ploughing profile presented by the plough, and hence vary the depth of trench which is cut.

The plough has the additional advantage that the second share can be fitted to an existing conventional plough chassis.

Typically, when the second share does present part of the ploughing profile it will plough a lower portion of the underwater bed, and the first share will plough an upper portion of the underwater bed. It should be understood that the terms "depth", "upper" and "lower" refer to relative positions when the plough is ploughing a generally horizontal underwater bed (as will normally be the case). In one example, the first share provides a ploughing profile (and hence minimum ploughing depth) of approximately 1 m with the second share retracted, and the second share can be extended to a maximum extension in which the ploughing profile is increased up to a maximum of approximately 3 m. In this case, when the second share is retracted the plough is no larger than a conventional 1 m burial plough, whilst providing a variable ploughing depth up to approximately 3 m.

The plough may be used for a number of purposes, but is particularly suited to the burial of an elongate member (such as a cable or pipe). In this case the plough typically comprises means (such as a conduit) for receiving the elongate member which is buried in use by the plough, and/or a depressor for guiding the elongate member by applying a downward force to the elongate member. In this case the depressor is preferably movable with respect to the first share, typically synchronously with the second share.

It is desirable to ensure that the action of the plough will not add forces to the elongate member as it is laid. A particular problem in all plough design is that upward soil reaction forces on the plough may be taken by the elongate member, and passed through the depressor to the plough structure, (rather than as preferred directly into the plough structure) if the plough sinks in soft conditions or if the depressor is lowered too far relative to the underside of the plough. The second share can be designed to minimize these forces. The second share may provide a backwardly raked cutting surface in at least one position. The backwardly raked surface will generate a soil reaction with an upward component to minimise the required heel force.

Typically the second share has a cutting portion which provides a cutting action (eg a cutting edge or face) and a heel portion behind the cutting portion (typically comprising a lower surface of the second share) which provides a bearing area for plough heel forces. In this case preferably the second share has an extended position in which a plane extending along the heel portion does not intersect with the depressor. This ensures that the heel portion bears the majority of the heel forces, and thus reduces heel forces on the elongate member. Alternatively, or in addition, the cutting portion and the heel portion may subtend an angle greater than 90 degrees. This enables the cutting portion to provide a backwardly raked blade whilst the heel portion runs horizontally.

The second share may be slidably mounted but preferably is pivotally mounted with respect to the first share.

The second share may be mounted separately from the first share, for instance the second share may be mounted behind the first share on a longitudinal plough beam. However preferably the second share is mounted to the first share. In this case the first share preferably comprises a pair of side plates, wherein the second share is mounted between the side plates. Typically the depressor and the elongate member are also at least partially located between the side plates.

Typically the second share has a retracted position in which it forms at least part of a plough heel behind the first share with respect to the ploughing direction. In this case the second share does not provide a cutting surface or ploughing profile when in its retracted position but offers a bearing area for plough heel forces.

The second share may be moved with respect to the first share by actuating means such as a hydraulic cylinder. Alternatively or in addition the plough may comprise resilient means which biases the second share towards an extended position with respect to the first share. In this case the second share may not be driven, but may simply adopt a particular position in response to the forces presented to it (i.e. the resilient force and the force presented by the ploughed material). In a preferable embodiment the actuating means and resilient means are provided by the same means, such as a hydraulic cylinder which is sprung with a hydraulic accumulator.

The plough may be towed from a ship or may be part of a self-motivating sub-sea vehicle. The actuating means is typically controlled from the ship via a data line but alternatively (particularly in shallow water) it may be controlled by divers.

Typically the plough is also constructed such that the rear of the plough can pitch back up to greater than 10–15°. This amount of pitch is normally prevented on conventional ploughs by stabilizing arms and other rearward structure. By allowing the rear of the plough to pitch back (particularly in soft soil) the depth of the plough profile can be maximized.

In accordance with a second aspect of the present invention there is provided a method of ploughing an underwater bed, the method comprising ploughing the bed with a plough comprising a first share and a second share which is movable with respect to the first share, and varying the depth of the ploughing profile presented by the plough by moving the second share with respect to the first share.

The second share may be moved during ploughing. Alternatively the ploughing may be temporarily stopped when the second share is adjusted.

Typically the method further comprises laying an elongate member in the ploughed underwater bed. In this case the burial depth can be controlled in accordance with burial requirements. For instance the elongate member may be buried more deeply in soft soils or sand where the risk of damage from external influences such as fishing gear is greatest. The elongate member may be laid during ploughing or may be laid in a trench which has been previously ploughed.

Preferably the method further comprises monitoring a parameter related to the amount by which the buried elongate member is protected from external influences, and varying the depth of the ploughing profile in accordance with the monitored parameter.

Typically the method comprises moving the second share when required in order to maintain the parameter substantially constant. This may be achieved by an operator on a surface ship, or by an automated feedback mechanism. By adjusting the second share (and hence the ploughing depth) a constant "burial protection index" can be achieved.

Preferably the parameter comprises the resistive force presented by the underwater bed to the plough. In the case of a towed plough, the parameter typically comprises one of the towing force and towing energy (i.e. force x speed). That is, the second share is adjusted such that a substantially constant towing force (or towing energy) is applied to the plough. With a constant towing force (or towing energy) the burial depth will increase and decrease in accordance with the strength of the ploughed undersea bed, but the burial protection index will remain substantially constant.

Alternatively the monitored parameter may comprise the strength of the material being ploughed. In this case the strength of the material being ploughed may have been previously monitored by carrying out a detailed survey of the stretch of underwater bed in which the cable is to be buried.

Typically the method further comprises adjusting a depressor with respect to the first share in accordance with the monitored parameter and/or the position of the second share.

BRIEF DESCRIPTION OF THE DRAWINGS

Some examples of a plough and a method of ploughing according to the present invention will now be described with reference to the accompanying drawings in which.

EMBODIMENT

Figure 1:
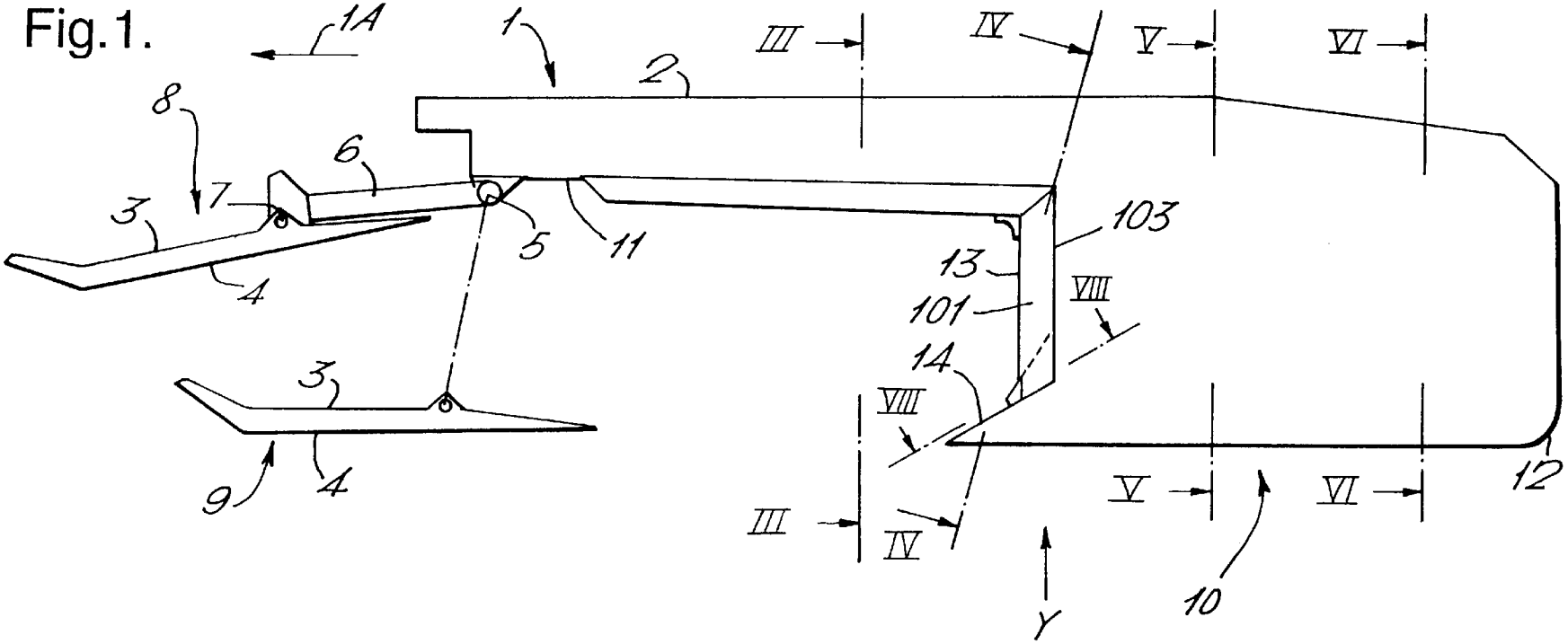
FIG. 1 is a side view of a plough with the lower share (not shown) retracted and the depressor omitted for clarity.

As shown in FIG. 1 a plough 1 has a beam 2 on the front end of which are a pair of skids comprising a left-hand skid 3 and a right-hand skid (hidden). A share assembly 10 is mounted at the rear of the beam 2.

The lower surface 4 of the skids provides stability to the plough by engaging with the seabed as the plough advances in a direction shown by an arrow 1A. Skid 3 is pivotally mounted to a skid arm 6 via a skid pivot 7. Skid arm 6 is pivotally mounted to beam 2 via a skid arm upper pivot 5. The left-hand skid 3 is shown in its raised position 8 and lowered position 9. In the lowered position illustrated at 9 the skid arm 6 is omitted for clarity. To adjust the depth of trench, the skids are driven between their lowered position 9 (no trench cut) and their raised position 8 (maximum depth of trench cut). The plough 1 also has a pair of burial depth limiting skids (shown in FIGS. 15 and 16 only).

Figure 2:
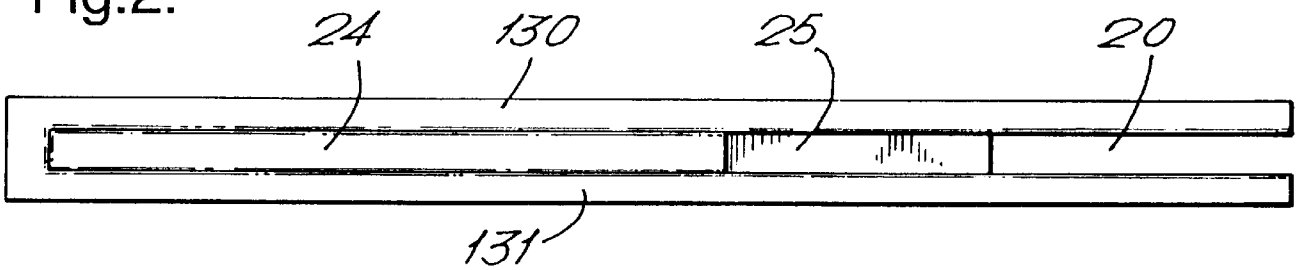
FIG. 2 is a plan view of the plough omitting the skids and skid arms.
Figure 3:
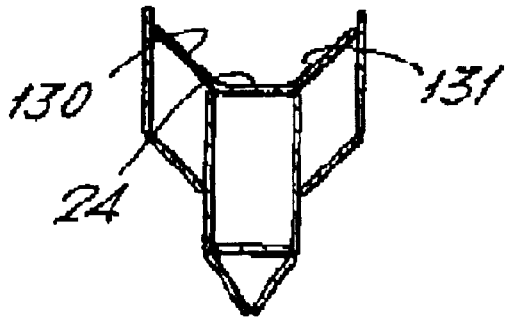
FIG. 3 is a cross-section along line III—III in FIG. 1.
Figure 4:
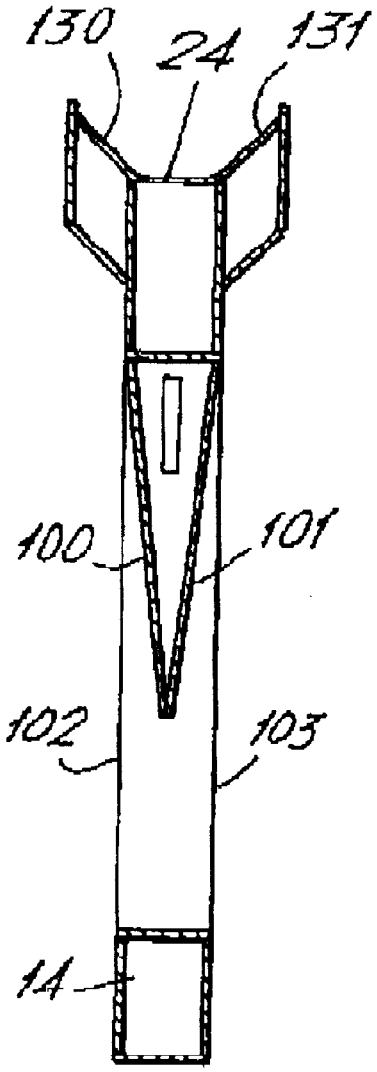
FIG. 4 is a cross-section along line IV—IV in FIG. 1.
Figure 7:
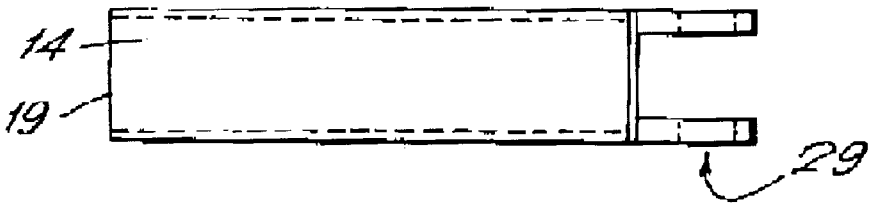
FIG. 7 is an underside view in direction Y of the point.
Figure 8:
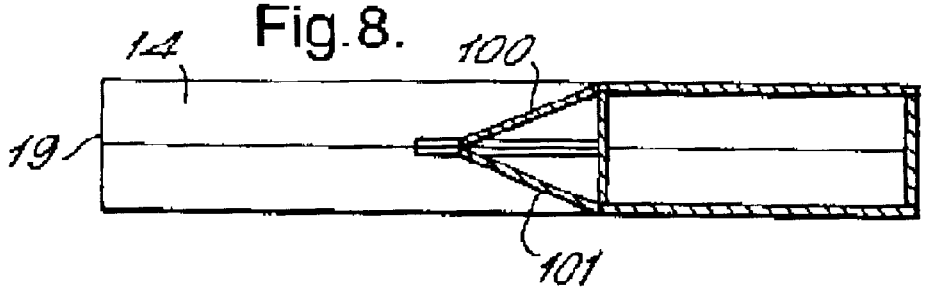
FIG. 8 is a cross-section along line VIII—VIII in FIG. 1.

The share assembly 10 comprises a first or upper share comprising a knife 13 and point 14. As shown in FIG. 4, the knife 13 comprises the cutting edge of a pair of tapering plates 100,101 which taper from a maximum width of 180 mm at 102,103 to a minimum width at the knife 13. A cable trough 24 with tapered sides 130,131 runs along the top of beam 2, as shown in FIGS. 2, 3 and 4. FIG. 7 shows that the base of point 14 is flat. As can be seen in FIG. 8 the point 14 tapers to a horizontal cutting edge 19.

Figure 5:
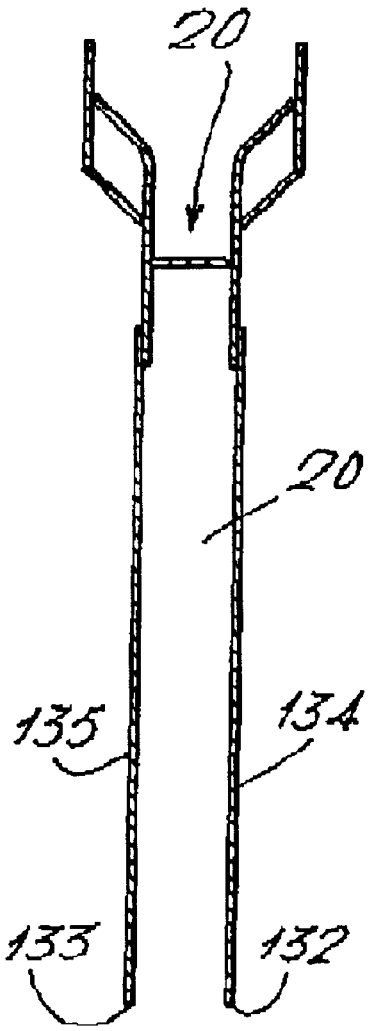
FIG. 5 is a cross-section along line V—V in FIG. 1 with the second share omitted.
Figure 6:
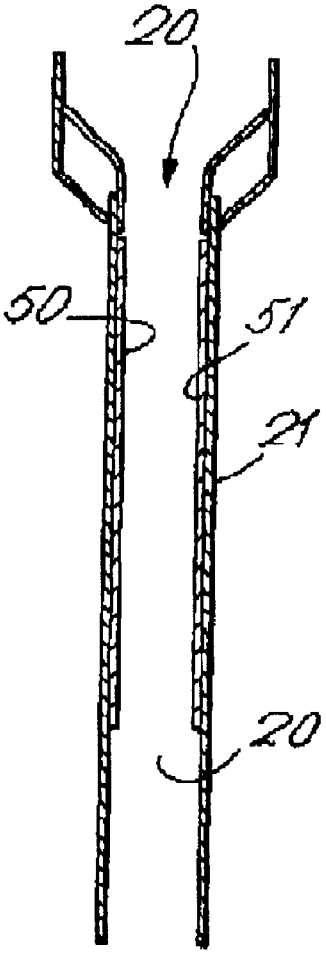
FIG. 6 is a cross-section along line VI—VI in FIG. 1, including the second share.
Figure 9:
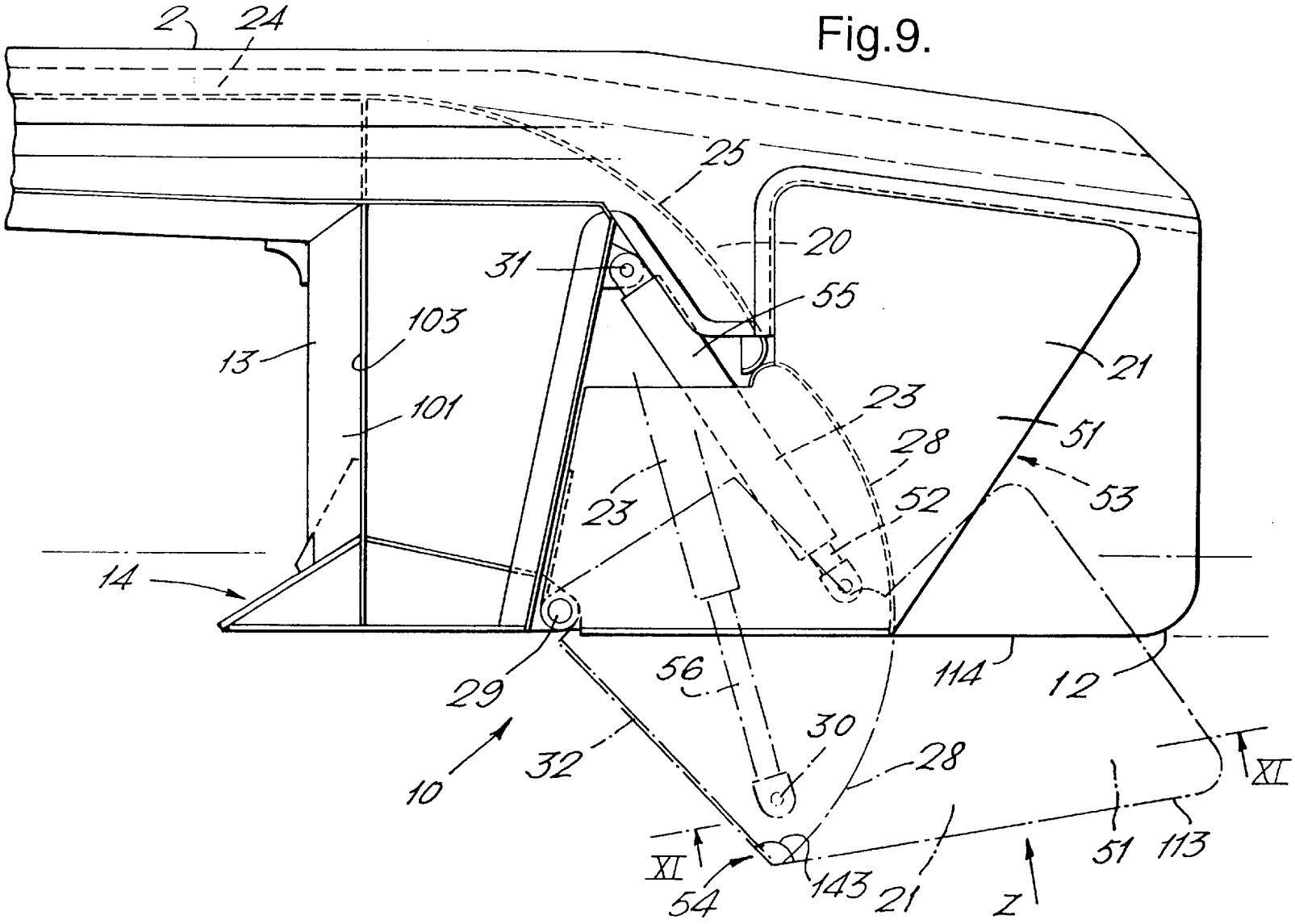
FIG. 9 is an enlarged side view of the share assembly, with hidden parts shown in phantom and with the depressor omitted.
Figure 14:
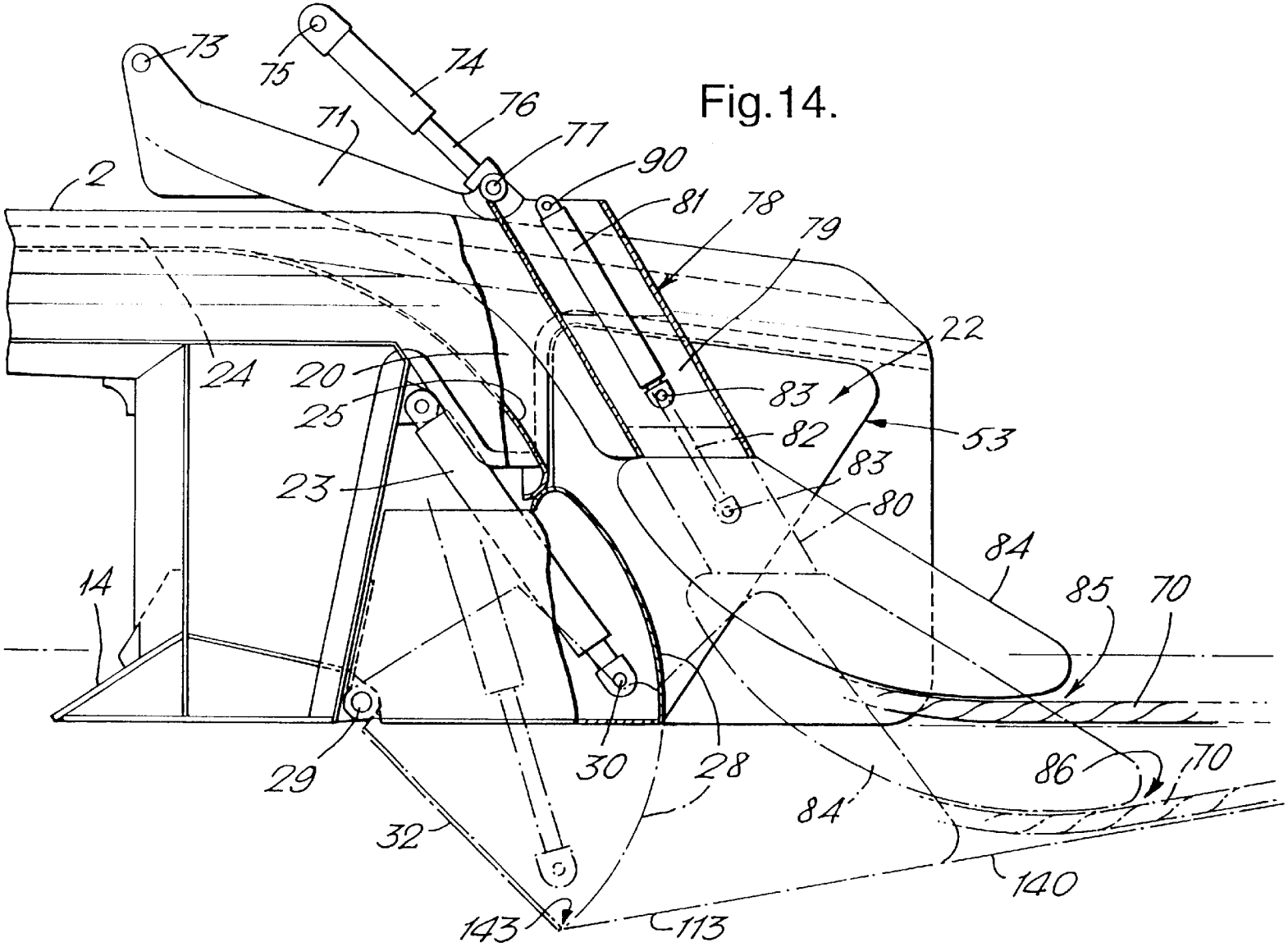
FIG. 14 is an enlarged side view of the share assembly during a cable laying operation with hidden parts shown, and with the depressor included.

The share assembly 10 comprises a pair of side plates 134,135 (FIG. 5) which define a cable slot 20 (FIG. 2) which houses an adjustable second or lower share 21 (shown in FIGS. 6 and 9 and omitted in FIG. 5), a depressor 22 (shown in FIG. 14) and a second share adjustment cylinder 23 (shown in FIGS. 9 and 14). A curved plate between the sideplates 134,135 defines an upper plough bend 25 (FIGS. 2 and 9).

Figure 10:
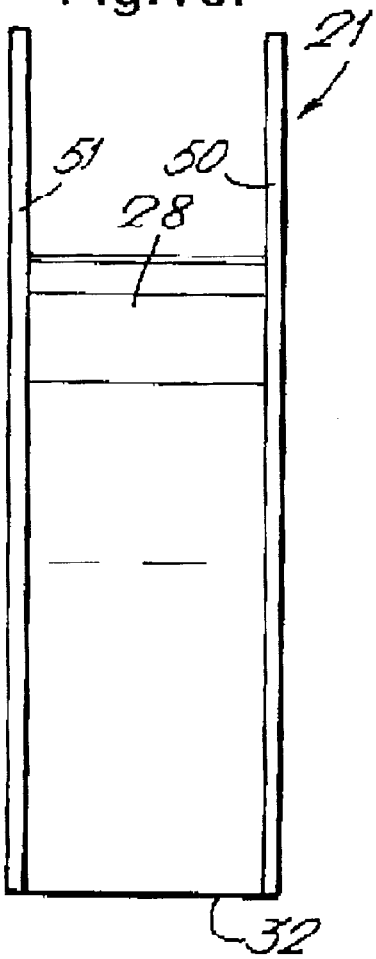
FIG. 10 is an underside view in direction Z of the second share.
Figure 11:
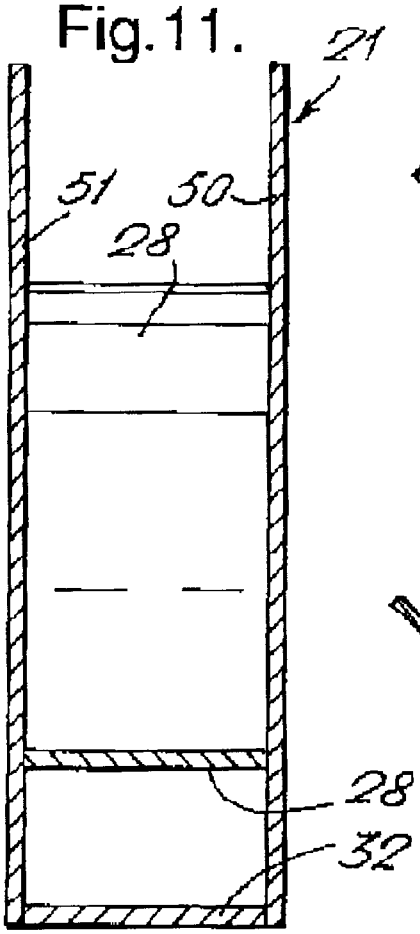
FIG. 11 is a cross-section along line XI—XI in FIG. 9.

As shown in FIGS. 9 to 11 the second or lower share 21 comprises a pair of sideplates 50,51 which are joined along opposite sides of a plate defining a cutting face 32 and along a curved lower plough bend 28. The second share 21 is pivotally mounted to the share assembly 10 at 29. The hydraulic cylinder 23 drives an actuating piston 52 which is pivotally mounted to the second share 21 at 30. The hydraulic cylinder 23 is pivotally mounted to the share assembly 10 at 31. FIG. 9 shows the second share in its raised position at 53 with the actuating piston 52 retracted at 55, and in its lowered position at 54 with the actuating piston 52 extended at 56. In its raised position 53 the lower share 21 does not present a ploughing profile, and the cutting face 32 of the second share 21 is flush with the ends 132,133 of sideplates 134,135. When the second share 21 is to be lowered, drive means (not shown) controlled from the surface of the water pressurizes the cylinder 23, driving the second share 21 into its lowered position 54. The cutting face 32 of the second share forms a backward raked cutting surface when in the lowered position 54. The second share may also be deployed in any intermediate position between raised position 53 and lowered position 54.

Figure 12:
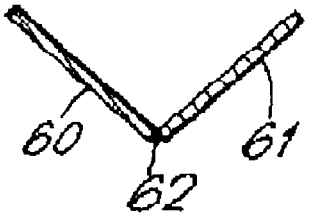
FIG. 12 is a cross-section through the cutting edge of an alternative second share.
Figure 13:
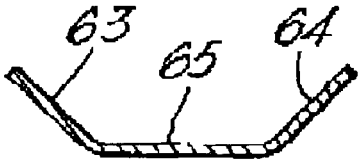
FIG. 13 is a cross-section through the cutting edge of a further alternative second share.

As illustrated in FIGS. 10 and 11, the cutting face 32 is a non-tapered flat face. Since the second share is only generally deployed in soft soil which can be easily cut by a blunt edge, it is not necessary for the cutting face 32 to taper to a point in the same manner as knife 13 and point 14 (which are for general use and therefore need to be able to cut through strong soils). However, the face 32 may be replaced by a pair of tapering plates 60,61 (FIG. 12) which meet at a point 62 in the same way as knife 13. Alternatively the face 32 may be replaced by a pair of tapering plates 63,64 (FIG. 13) which are joined by a horizontal plate 65. This provides a compromise between the flat face 32 of FIGS. 10 and 11 which provides a wide surface for the plough bottom when the second share is raised, and the cutting edge 62 which provides a narrower plough heel area but cuts more efficiently.

As shown in FIG. 14, during cable burial a cable 70 is paid off from the stern of a ship which also tows the plough 1. The cable 70 passes along cable trough 24 and is guided into cable slot 20 and around upper plough bend 25 by depressor upper arm 71.

The depressor upper arm 71 is pivotally mounted to a support frame (not shown) at 73. The upper arm 71 is driven from a raised position (not shown) to the lowered position shown in FIG. 14 by a hydraulic actuator comprising hydraulic cylinder 74 pivotally mounted to the support frame at 75, and an actuating piston 76 pivotally mounted to the upper arm 71 at 77. The upper arm 71 comprises a cylinder 78 which houses a sliding arm shown in its raised position at 79 and its lowered position at 80. The sliding arm is driven between its raised and lowered positions by a hydraulic actuator comprising a hydraulic cylinder 81 which is mounted to the upper arm 71 at 90 and an actuating piston 82 which is mounted to the sliding arm at 83. Depressor lower arm 84 is mounted on the end of the sliding arm, and defines a cable exit point 85,86 at the bottom of the ploughed trench.

With the second share 21 fully extended, the heel surface 113 of the second share 21 behind the cutting surface 32 runs approximately horizontally and bears plough heel forces. In this position a plane 140 along the heel surface 113 passes below and behind the share assembly 10 and the cable exit point 86 and therefore does not intersect with the cable 70 or the depressor lower arm 84. In addition the angle 143 between the cutting surface 32 and the heel surface 113 is greater than 90 degrees (in this example the angle 143 is approximately 135 degrees).

Figure 15:
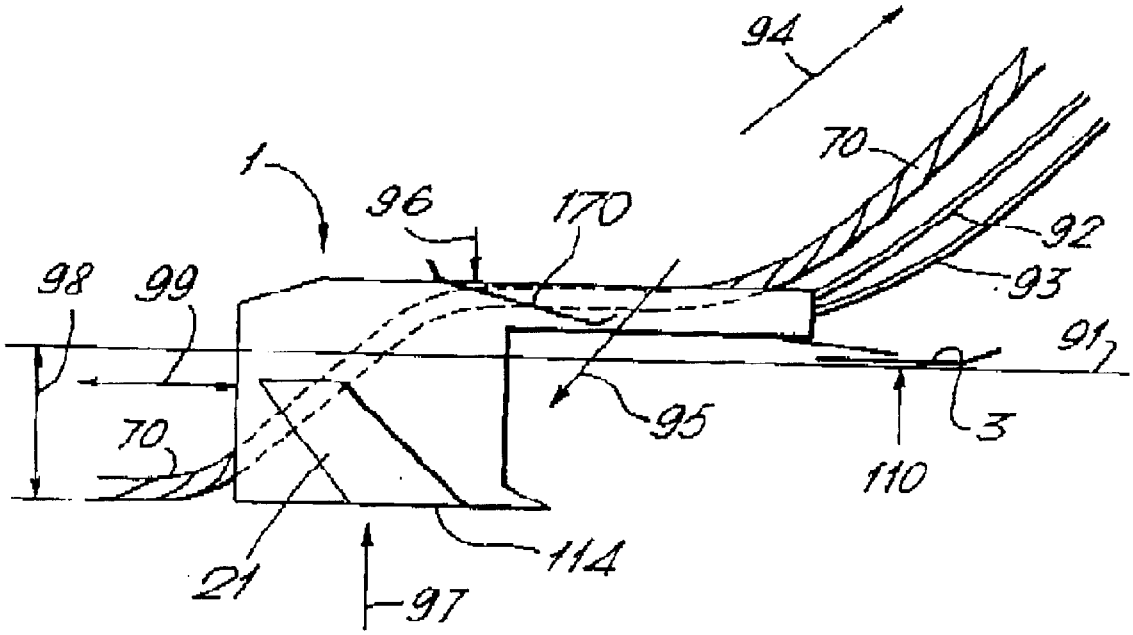
FIG. 15 is a schematic side view of a cable being buried with the second share raised.
Figure 16:
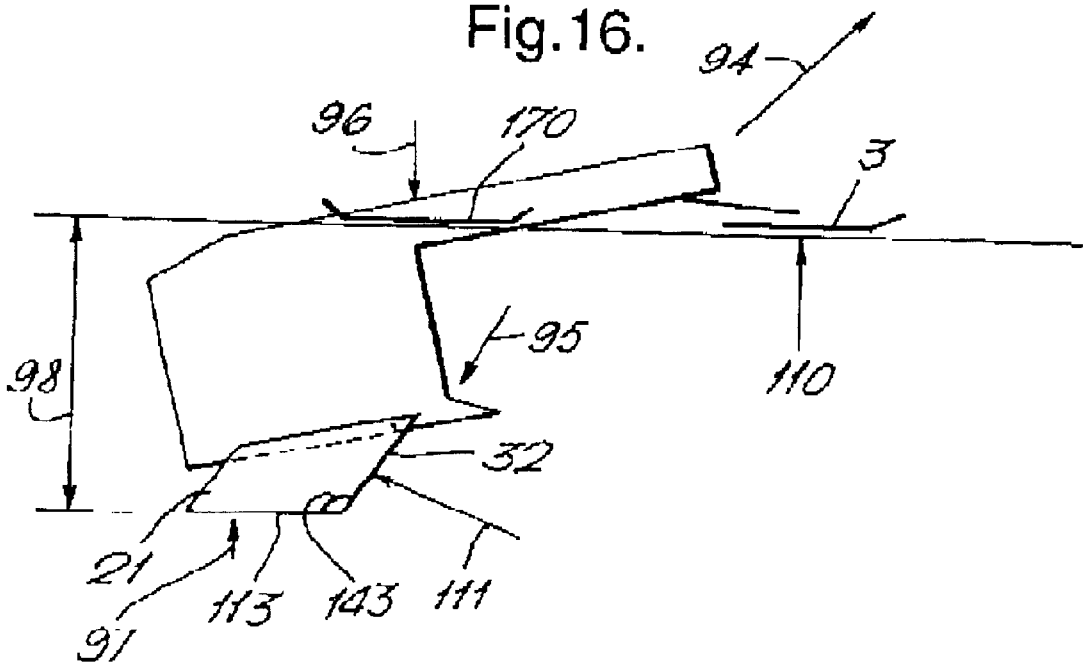
FIG. 16 is a schematic side view of a cable being buried in soft soil with the second share lowered.

FIGS. 15 and 16 are schematic side views of the plough 1 burying a cable 70. In FIG. 15 the cable 70 is being buried in hard soil 91 and therefore the second share 21 is in its raised position. In this position the plough operates in a similar fashion to a conventional long beam plough. The plough 1 is towed by a tow wire 92 and the second share 21, depressor 22 (see FIG. 14) and skids 3 are controlled by control signals which are transmitted to the plough from the ship via data line 93. The main forces operating on the plough are a towing force 94, soil force 95, plough weight force 96, skid force 110 and heel force 97. In a conventional plough, additional upward force may be provided by rear (wheeled) stabilizers or skids which run along the surface and ensure that the plough runs level. In this case, the conventional skids are replaced by a pair of fixed skids 170 (only the right-hand skid 70 being shown) which are fixed at an angle (e.g. 10–15°) to the plough beam. The burial depth 98 in hard soils is typically of the order of 1 m. The ploughed trench collapses behind the plough to bury the cable 70.

When the plough 1 encounters soft soil, the heel force 97 decreases and the plough pitches back to the position shown in FIG. 16. The second share 21 can also be 15 deployed in soft soil and the edge 32 provides a backwardly raked cutting blade. When the second share 21 is in its lowered position shown in FIG. 16, it experiences a second share cutting force 111 and an upward force generated along the beam of the plough, i.e. directly under arrow 96 in FIG. 16. The fixed skids 170 limit the pitch of the plough to a required maximum pitch angle (e.g. 10–15°). If a large amount of pitch is required, the skids 170 may be omitted entirely. In this position the surface 113 of lower share 21 is approximately horizontal. If the soil is soft enough the burial depth 98 can increase up to approximately 3 m. However if the soil is hard the second share cutting force 111 may increase so that the plough tends to lift out of the ground. Hence the second share is most usefully deployed in softer ground.

In hard soil when the skids are in their raised position 8 (FIG. 1) and the second share is retracted, the plough runs at 0° pitch. That is, the base 114 of the share assembly 10 (formed by the lower edges 132,133 of sideplates 134,135 and the cutting face 32 of the lower share 21) runs parallel with the seabed 91 and provides a plough heel surface which bears the plough heel force 97. In this case the ploughing profile (given by the height from the lowest point 12 (FIG. 9) of the share assembly 10 to the lower surface 4 of skid 3) is approximately 1 meter. In soft soil the ploughing profile is increased in two ways, namely:

(1) the plough pitches back by approximately 10–15° (i.e. the base 114 of the share assembly pitches back to an angle of 10–15° with the seabed); and (2) the second share 21 is lowered into the position shown in FIG. 16.

In soft soil the ploughing profile can increase as a result up to 3 meters.

The plough is prevented from sinking too far by the burial depth limiting skids 170 which ensure that the plane 140 (FIG. 14) is horizontal or angled up (looking backwards). In addition, the actuator 81 of depressor lower arm 84 is controlled in conjunction with second share actuator 23 to ensure that the depressor is not lowered far enough to add forces to the cable 70.

Figure 17:
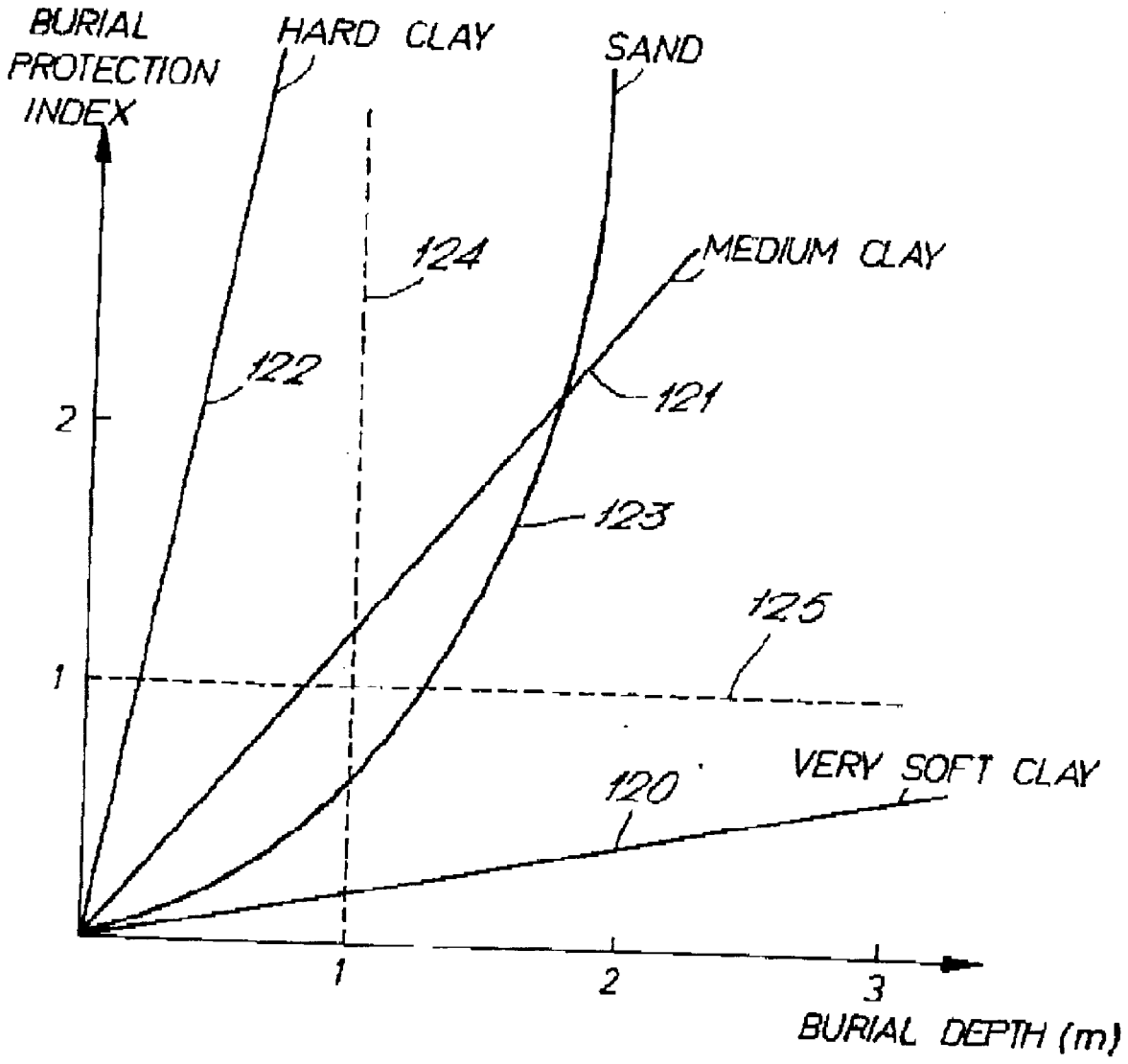
FIG. 17 is a graph illustrating the possible variation of burial protection index with burial depth for a number of varying soils.

A method of cable burial using the plough 1 based upon a Burial Protection Index (BPI) will now be described. BPI is a parameter relating to the degree of protection provided to the cable from external influences such as fishing gear or anchors. FIG. 17 is a graph illustrating the variation in BPI with burial depth, assuming that the plough is towed at low speed. Fishing gear or anchors will also tend to be towed at low speed, so this is a valid simplification to the analysis. The low speed assumption is also conservative, in that for a given tow force the penetration depth achieved (for instance by a plough or anchor grapnel trawl board) will diminish with increased speed. Four example lines 120–123 are shown in FIG. 17. In very soft clay the burial protection index may vary with depth as indicated at 120. The gradient of the line 120 is so shallow that doubling the burial depth only leads to a small increase in BPI. However, to achieve that doubling in burial depth may be very expensive (eg requiring a bigger plough, bigger ship required to launch the bigger plough etc.) and this may not be cost effective. Ultimately in very soft soils, burial cannot provide good protection and armour may be the better solution. The likely variation of BPI for a clay with medium cohesiveness is illustrated at 121, and the likely variation for a hard clay is illustrated at 122. The likely variation in BPI for sand is illustrated at 123.

A conventional constant burial depth specification is given by a vertical line 124 on the graph of FIG. 17. It is clear from line 124 that a cable buried to 1 m in very soft clay will be provided with a much smaller degree of protection than in hard clay. In contrast, a method of burial according to the present invention involving a constant BPI would use a horizontal line 125 on the graph up to the maximum burial depth of the plough. For any given plough there is a maximum BPI capability limited by plough weight.

Two methods of cable burial which attempt to achieve a constant BPI will now be described.

Figure 18:
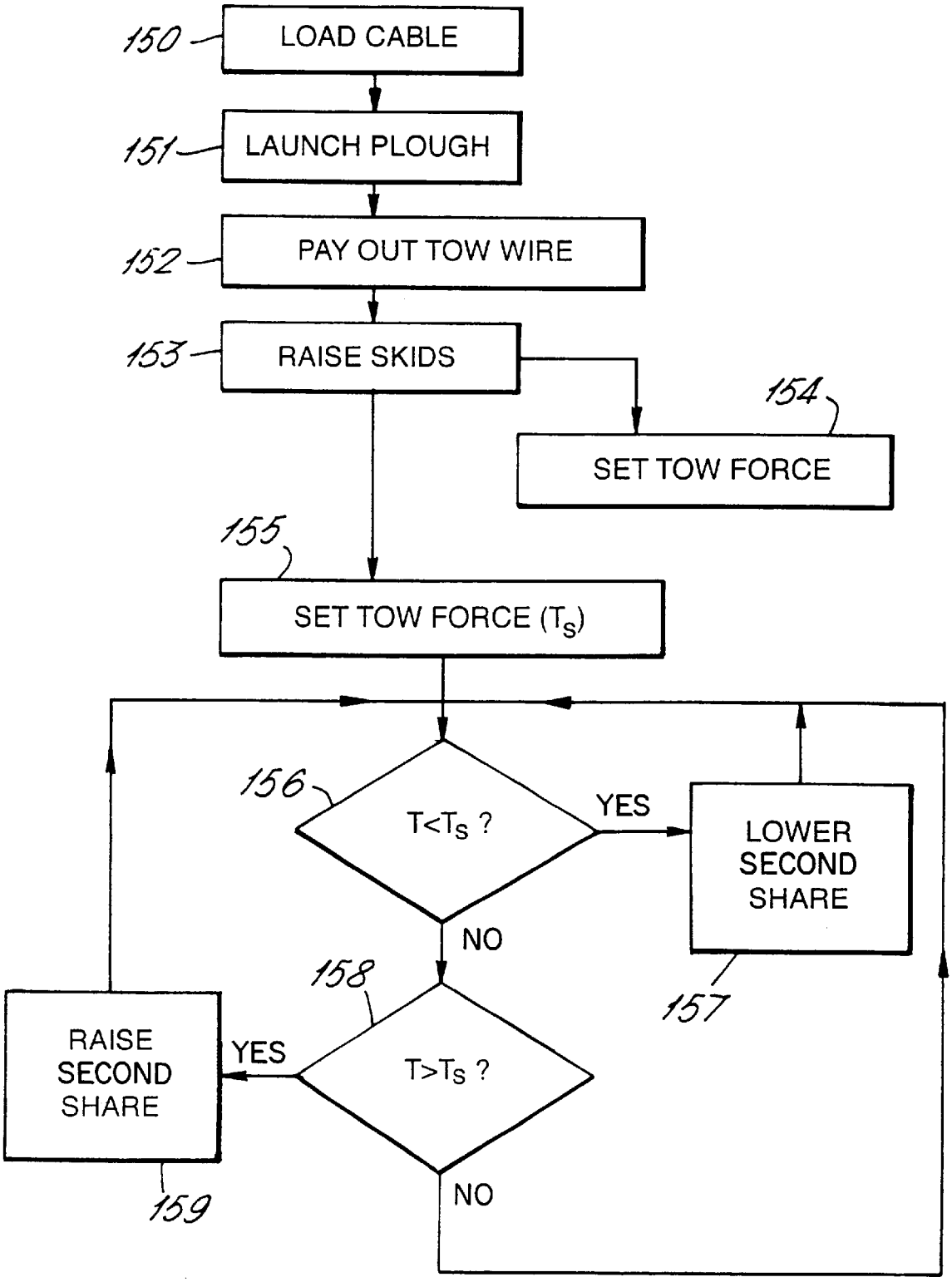
FIG. 18 is a flow diagram illustrating two alternative burial methods according to the present invention.

FIG. 18 is a flow diagram illustrating important steps in two alternative burial methods. The first five method steps are common to both methods. In a first step 150 the cable is loaded into the plough on the deck of the ship prior to launch. Throughout ploughing operations the cable runs through the plough structure. The plough is launched at 151 from the ship and landed on the seabed with the skids fully down, the depressor down sufficiently to ensure that the cable is trapped between the share side plates, and the second share fully retracted. Once the plough is landed on the seabed, the plough tow wire is paid out at 152 from the winch on the ship to establish the towing catenary. As the plough moves ahead the skids are raised gradually at 153 to achieve deeper burial. At this stage the operator will monitor the cable tension measured at the depressor, and if this is higher than anticipated may lift the depressor fractionally to ensure that the weight of the plough is not bearing on the cable, assuming that the burial depth requirement is being met. Typical variables which are monitored during operation are the plough position, plough speed, burial depth achieved and cable tension. The burial depth may be measured in a number of ways. For example, the burial depth may be given by a combination of the angle of deployment of the skid arms 6 and the angle of deployment of the second share 21. The cable tension is measured at the depressor 22. These variables are transmitted to the ship via data line 93 and recorded for later analysis. If the plough gets stuck or is in hard ground with unacceptably high cable tension or poor progress rate the skids may be lowered to reduce the burial depth.

Depending upon the type of plough used, two different methods may be employed. In a first type of plough the second share 21 is biased towards its lowered position by resilient means such as a spring or a hydraulic cylinder sprung with a hydraulic accumulator. The biasing force may be adjustable. In this case the second share 21 is always automatically working to maximum depth for the soil conditions. For example, in hard soil the soil force 97 will force the second share 21 into its raised position against the biasing force. When the strength of the soil decreases, the force 97 will decrease, allowing the plough to pitch back and the second share to lower slightly. With this type of passively adjusting second share, the operator merely needs to set the tow force (and optionally the biasing force) at 154, and the position of the second share will adjust automatically to achieve an approximately constant tow force.

In a second type of plough the second share 21 is actively controlled by an operator on the ship or by suitable software. In this case, the operator sets the desired tow force $T_s$ (related to the desired BPI) at 155, and the position of the second share is adjusted by a suitable feedback loop to maintain the tow force T at approximately the desired tow force $T_s$. That is, the tow force T is monitored during a cable burial operation, and if the tow force T drops below the required tow force $T_s$ at 156, the operator (or the software) lowers the second share at 157 to increase the burial depth. If, alternatively, the tow force T rises above the desired towing force $T_s$ at 158, the operator or software raises the second share at 159. Typically the second share is activated by a double acting hydraulic cylinder. The circuitry incorporates a high volume flow pressure relief valve so that if a hard obstacle is struck the second share can move back to clear the obstacle. The second share is lowered and retracted on the move. If the operator observes that lowering the second share is causing the plough to come out of the ground, then the operator will not lower the second share any further.

The second share will only increase burial depth where the ground is not hard enough to generate up forces sufficient to lift the plough out. During shallower burial ploughing the operator will be able to develop a good feel for when the second share can be deployed, by monitoring tow force T and plough pitch.

In an alternative the stretch of seabed in which the cable is being buried may have been surveyed previously, and the second share is deployed in accordance with previously measured soil cohesiveness values.

In the methods described above the depressor is operated in conjunction with the second share. The depressor has two stage control as previously described, with two independent hydraulic cylinders 74, 81. The first cylinder 74 raises and lowers the depressor down to the maximum required for the fixed part of the plough (i.e. the top one meter of burial). The second cylinder 81 moves the lower depressor arm 84 down within the lowered second share. A software lock prevents the second share being deployed unless the first actuating piston of 76 is fully extended. This ensures that the depressor is always running within the side plates 50,51 of the second share and that there is no opportunity for the cable 70 to escape up the side. Clearly the cable diameter needs to be large compared to the gap between the depressor and the share side plates.

The plough design previously described is particularly suited to a constant BPI. It has the same capability as a standard plough down to one meter burial depth, and can bury deeper in soft soils. For the one meter to three meter depth range it has variable geometry which can either be actuated from the ship or may be sprung such that the depth achieved is always automatically maximized for a given plough geometry and tow force, within certain limits.

The methods illustrated in FIG. 18 have a number of advantages. In particular:

(a) Ploughed sections of the route can be done at constant vessel thrust, making scheduling more accurate and improving fuel consumption and operational efficiency.

(b) There is no longer a requirement for a "guaranteed burial depth" and or even a target burial depth, since the depth will increase and decrease with soil strength. As long as the vessel is putting sufficient energy into the plough the targeted BPI is achieved.

(c) Since the cable is buried according to a desired BPI, the cable also has consistent recoverability, and a suitable grapnel can be designed to match. There is no risk of excessively deep burial.

(d) A corollary of (b) above is that less survey data is required. It is not necessary to know the type of soil or soil strength before carrying out a cable burial operation, although it is necessary to ensure that there is sufficient depth of sediment to bury the cable in so that the cable armouring type is appropriate.

I claim:

1. An underwater plough for ploughing an underwater bed, said plough presenting a ploughing profile defining a ploughing depth, said plough comprising a first share and a second share, wherein said second share is movable with respect to said first share between a retracted non-ploughing condition and an extended condition in which said second share cooperates with said first share to present an increased ploughing depth.

2. A plough according to claim 1 further comprising means for receiving an elongate member which is buried in use by said plough.

3. A plough according to claim 1 further comprising a depressor for applying a downward force to an elongate member which is laid in use by said plough.

4. A plough according to claim 3 wherein said depressor is movable with respect to said first share.

5. A plough according to claim 4 wherein said depressor comprises an upper arm which is movable with respect to said first share and a lower arm which is movable with respect to said upper arm.

6. A plough according to claim 5 further comprising drive means for moving said upper arm and drive means for moving said lower arm.

7. A plough according to claim 3, wherein said second share has a cutting portion and a heel portion behind said cutting portion, and wherein said second share has an extended position in which a plane extending along said heel portion does not intersect with said depressor.

8. A plough according to claim 1 wherein said second share is pivotally mounted.

9. A plough according to claim 1 wherein said second share is mounted to said first share.

10. A plough according to claim 9 wherein said first share comprises a pair of side plates, and said second share is mounted between said pair of side plates.

11. A plough according to claim 1 wherein said second share forms at least part of a plough heel behind said first share when said second share is in said retracted non-ploughing position.

12. A plough according to claim 1 further comprising drive means for driving said second share between extended and retracted positions with respect to said first share.

13. A plough according to claim 1 further comprising resilient means which biases said second share towards an extended position with respect to said first share.

14. A plough according to claim 1, wherein in at least one position said second share provides a backwardly raked cutting surface.

15. A plough according to claim 1, wherein said second share has a cutting portion and a heel portion behind said cutting portion, and wherein said cutting portion and said heel portion sublend an angle greater than 90°.

16. A plough according to claim 1, wherein said plough is adapted to enable said plough to pitch back in use.

17. A method of ploughing an underwater bed, the method comprising ploughing said underwater bed using a plough presenting a ploughing profile defining a ploughing depth, said plough comprising a first share and a second share, wherein said second share is movable with respect to said first share between a retracted non-ploughing condition and an extended condition; and increasing said ploughing depth by moving said second share with respect to said first share to said extended condition whereby the first and second shares cooperate to present said increased ploughing depth.

18. A method according to claim 1, further comprising laying an elongate member in the ploughed underwater bed.

19. A method according to claim 18, further comprising monitoring a parameter related to the amount by which said buried elongate member is protected from external influences, and varying said ploughing depth in accordance with said monitored parameter.

20. A method according to claim 19 wherein said parameter comprises the resistive force presented by said underwater bed to said plough.

21. A method according to claim 19 further comprising towing said plough along the underwater bed, therein said parameter comprises one of the towing force and towing energy.

22. A method according to claim 19, wherein said parameter comprises the strength of the material being ploughed.

23. A method according to claim 6, wherein said plough further comprises a depressor for applying a downward force to said elongate member, the method further comprising adjusting said depressor with respect to said first share in accordance with the position of said second share.

* * * * *